United States Patent [19]

Winter et al.

[11] Patent Number: 4,781,050

[45] Date of Patent: Nov. 1, 1988

[54] PROCESS AND APPARATUS FOR PRODUCING HIGH REDUCTION IN SOFT METAL MATERIALS

[75] Inventors: Joseph Winter, New Haven; Michael J. Pryor, Woodbridge, both of Conn.

[73] Assignee: Olin Corporation, New Haven, Conn.

[21] Appl. No.: 341,411

[22] Filed: Jan. 21, 1982

[51] Int. Cl.[4] ..... B21B 13/14; B21B 13/04; B21B 35/08

[52] U.S. Cl. ..... 72/241; 72/205; 72/229; 72/232; 72/249; 72/366

[58] Field of Search ..... 72/365, 366, 241, 242, 72/205, 249, 234, 229, 19, 232

[56] References Cited

U.S. PATENT DOCUMENTS

| | | | |
|---|---|---|---|
| 1,466,459 | 8/1923 | Perry | 72/241 |
| 1,964,503 | 6/1934 | Coryell | 72/229 |

(List continued on next page.)

FOREIGN PATENT DOCUMENTS

| | | | |
|---|---|---|---|
| 50860 | 8/1970 | Australia . | |
| 46551 | 3/1974 | Australia . | |
| 691139 | 12/1966 | Belgium . | |
| 363259 | 11/1922 | Fed. Rep. of Germany . | |
| 2559016 | 7/1977 | Fed. Rep. of Germany | 72/19 |
| 1506671 | 12/1967 | France . | |
| 1506680 | 12/1967 | France . | |
| 2371246 | 8/1978 | France . | |
| 54-5848 | 1/1979 | Japan . | |
| 54-10258 | 1/1979 | Japan . | |
| 0150357 | 11/1979 | Japan | 72/234 |
| 259793 | 4/1970 | U.S.S.R. . | |
| 775096 | 5/1957 | United Kingdom . | |
| 1002936 | 9/1965 | United Kingdom . | |
| 1086643 | 10/1967 | United Kingdom . | |
| 1087097 | 10/1967 | United Kingdom . | |
| 1117585 | 6/1968 | United Kingdom . | |
| 1125554 | 8/1968 | United Kingdom . | |
| 1219967 | 1/1971 | United Kingdom . | |
| 1223188 | 2/1971 | United Kingdom . | |
| 2004486A | 4/1979 | United Kingdom . | |

OTHER PUBLICATIONS

Coffin, Jr., "Status of Contact-Bend-Stretch Rolling", *Journal of Metals*, Aug. 1967, pp. 14–22.

Vydrin et al., "New Sheet-Rolling Process from Russia", *Machinery and Production Engineering*, vol. 128, No. 3319, Jul. 21, 1976, Burgess Hill, Sussex, Great Britain.

Hollmann et al., "Shear Rolling, A New Cold Rolling Method–Rolling Process and Rolling Mill Equipment", *Stahl and Eisen*, vol. 99, No. 6, Mar. 26, 1979, Dusseldorf, Germany.

Hoffman et al., *Introduction to the Theory of Plasticity for Engineers*, McGraw-Hill, 1953, pp. 214–239.

Tobin et al., "Control of Thickness of Metal Sheet and Strip", *Sheet Metal Industries*, Mar. 1960, pp. 203–213.

Robertson et al., "Further Experimental Data on Rolling Tin-Plated Strip in the S-Mill", *Metals Technology*, Jul. 1977, pp. 365–374.

Roberts, "The Schloemann Mill", *Cold Rolling of Steel*, Marcel Dekker, Inc., 1978, pp. 32–33.

*Primary Examiner*—Robert L. Spruill
*Assistant Examiner*—Steven B. Katz
*Attorney, Agent, or Firm*—Paul Weinstein

[57] ABSTRACT

A process and apparatus for producing increased reductions in strip material, particularly soft metal strip materials, are disclosed. The process and apparatus utilize a rolling mill having at least two offset work rolls driven at a peripheral speed ratio less than a desired gage reduction ratio but greater than zero and a mechanism for applying forward tension to the strip material. The desired gage reduction may be obtained using reduced separating force magnitudes and minimized tension force magnitudes. The rolling mill utilizes relatively small diameter work rolls without having to provide additional support structures other than the back-up rolls and frame roll supports to prevent roll bending in the rolling direction. Roll flattening is substantially eliminated resulting in improved gage control and strip flatness.

20 Claims, 2 Drawing Sheets

U.S. PATENT DOCUMENTS

| | | | |
|---|---|---|---|
| 2,291,361 | 7/1942 | Walsh | 148/4 |
| 2,316,067 | 4/1943 | Hickman | 72/161 |
| 2,332,796 | 10/1943 | Hume | 72/160 |
| 2,370,895 | 3/1945 | Wean | 72/161 |
| 2,392,323 | 1/1946 | Koss | 72/164 |
| 2,526,296 | 10/1950 | Stone | 72/164 |
| 3,238,756 | 3/1966 | Coffin, Jr. | 72/232 |
| 3,253,445 | 5/1966 | Franek | 72/164 |
| 3,332,292 | 7/1967 | Roberts | 72/8 |
| 3,377,830 | 4/1968 | Campbell | 72/205 |
| 3,394,574 | 7/1968 | Franek et al. | 72/205 |
| 3,527,078 | 8/1968 | Lawson et al. | 72/160 |
| 3,616,669 | 11/1971 | Shumaker | 72/241 X |
| 3,709,017 | 1/1973 | Vydrin et al. | 72/205 |
| 3,798,950 | 3/1974 | Franek et al. | 72/205 |
| 3,811,307 | 5/1974 | Vydrin et al. | 72/205 |
| 3,823,593 | 7/1974 | Vydrin et al. | 72/205 |
| 3,861,188 | 1/1975 | Kamit et al. | 72/234 |
| 3,871,221 | 3/1975 | Vydrin et al. | 72/205 |
| 3,911,713 | 10/1975 | Vydrin et al. | 72/205 |
| 4,244,203 | 1/1981 | Pryor et al. | 72/205 |
| 4,253,322 | 3/1981 | Vydrin et al. . | |
| 4,257,252 | 3/1981 | Vydrin et al. . | |
| 4,267,720 | 5/1981 | Vydrin et al. . | |
| 4,365,496 | 12/1982 | Shiozaki et al. | 72/366 X |
| 4,382,375 | 5/1983 | Yamamoto et al. | 72/205 |

PROCESS AND APPARATUS FOR PRODUCING HIGH REDUCTION IN SOFT METAL MATERIALS

This invention relates to rolling mills and a process and apparatus for increasing the amount of reduction that can be taken in a strip material during a single pass. The invention described herein is applicable to a wide range of metals and alloys which are capable of plastic deformation.

Conventionally, rolling mills are found with many different configurations including two-high, four-high and cluster mills. In these conventional mills, the total reduction which can be achieved in the metal strip before annealing is required is determined by the roll separating force generated during the rolling operation. This separating force increases from pass to pass as the metal strip becomes work hardened until a maximum limit is reached for the mill. When the separating force reaches a sufficiently high level, roll flattening, mill elasticity and strip flow strength are in balance and the mill ceases to make any significant further reductions in the strip thickness. Normally, prior to the strip reaching such as separating force level, further rolling is uneconomic and the strip is annealed to make it softer and thereby reduce the separating force in the next pass through the mill.

It is desirable that the percent reduction in thickness per pass and the total reduction which can be taken in the strip by a rolling mill between anneals be as large as possible so as to reduce the need for costly and time-consuming anneals. It is known in the prior art that relatively small diameter work rolls can be used to produce greater percentage reductions on strip materials. This is because small diameter work rolls reduce the roll forces involved. However, small diameter work rolls have less rigidity and are frequently subjected to roll bending or bowing as a result of the separating forces needed to effect the reductions. This roll bending or bowing can adversely affect both the gage and the flatness of the strip material. Various approaches for achieving the desired increases in reduction at reduced separating forces have been suggested. In most of these techniques, a stretching component has been added to the rolling reduction in order to provide increased percentages of reduction.

One rolling approach comprises contact-bend-stretch rolling, also known as C-B-S rolling. This technique is illustrated in U.S. Pat. No. 3,238,756 to Coffin, Jr., in an article by Coffin, Jr. in *The Journal of Metals,* August, 1967, pages 14–22 and in U.K Patent Specification No. 1,125,554 to Coffin, Jr. In the C-B-S rolling process, plastic bending is provided in conjunction with longitudinal tension and rolling pressure to provide strip or foil thickness reductions. The speed ratio between the contact rolls of the mill is utilized as a means for determining and controlling reduction in place of a conventional rigid roll gap. Longitudinal thickness uniformity is preferably maintained by sensing incoming strip thickness to detect longitudinal thickness variations and then adjusting the speed ratio accordingly. This apparatus is more fully described in the aforenoted article and patents by Coffin, Jr.

Yet another prior art approach comprises a process of rolling metal sheet commonly referred to as "PV" rolling. This process is illustrated in U.S. Pat. Nos. 3,709,017 and 3,823,598 both to Vydrin et al. In this process, a sheet is passed between driven rolls of a rolling mill wherein each adjacent roll is rotated in a direction opposite to that of a next adjacent roll and at a different peripheral speed with respect thereto. The rolls are driven so that the roll speed ratio is equal to the reduction in the sheet being rolled. Tension is applied to at least the leading portion of the strip. The application of back tension is also described.

U.S. Pat. Nos. 3,811,307, 3,871,221, 3,911,713, 4,253,322, 4,257,252 and 4,267,720 all to Vydrin et al., French Demande De Brevet D'Invention No. 2,371,246 to Vydrin et al., "New Sheet-Rolling Process from Russia", *Machinery and Production Engineering,* Vol. 128, No. 3319, July 21, 1976, Burgess Hill, Sussex, Great Britain, and "Shear Rolling, A New Cold Rolling Method—Rolling Process and Rolling Mill Equipment", Hollmann et al., *Stahl and Eisen,* Vol. 99, No. 6, Mar. 26, 1979, Dusseldorf, Germany discuss various aspects of PV rolling as well as modifications and improvements which have been made to the PV rolling mill and process.

Many other techniques have been suggested for rolling in a non-conventional manner using such expedients as stretching of the strip, offset roll configurations, and/or small diameter rolls. Illustrative of such processes and apparatuses are: U.S. Pat. Nos. 2,291,361 to Walsh, 2,316,067 to Hickman, 2,331,796 to Hume, 2,370,895 to Wean, 2,392,323 to Koss, 2,526,296 to Stone, 3,253,445 to Franek, 3,332,292 to Roberts, 3,388,830 to Campbell, 3,394,574 to Franek et al., 3,527,078 to Lawson et al., 3,798,950 to Franek et al., and 3,861,188 to Kamit et al.; Australian Patent Document Nos. 46,551 and 50,860; Belgium Patent Document No. 691,139; Fed. Rep. of German Patent Document No. 363,259; French Patent Nos. 1,506,671 and 1,506,680; Japanese Patent Nos. 54-5848 and 54-10258; U.K. Patent Specification Nos. 1,002,936, 1,086,643, 1,087,097, 1,117,585, 1,219,967 and 1,223,188; Russian Patenr No. 259,793, *Introduction to the Theory of Plasticity for Engineers,* Hoffman et al., McGraw-Hill, 1953, pp. 214–239; "Control of Thickness of Metal Sheet and Strip", Tobin et al., *Sheet Metal Industries,* March 1960, pp. 203–213; "Further Experimental Data on Rolling Tin-plated Strip in the S-Mill", Robertson et al., *Metals Technology,* July 1977, pp. 365–374; and "The Schloemann Mill", Roberts, *Cold Rolling of Steel,* Marcel Dekker, Inc., 1978, pp. 32–33.

Frequently, rolling mills that utilize small diameter work rolls have problems with bending or bowing of one or more of the work rolls in the direction of rolling. In order to prevent the bending of the work rolls, the mill is provided with additional structures that contact the work rolls to hold them in position. U.K. Patent Specification No. 775,096 and the Schloemann Mill exemplify mills having small diameter work rolls and inserts or supports for preventing horizontal bowing of the rolls.

Yet another approach to reducing the thickness of strip material is disclosed in U.S. Pat. No. 4,244,203 to Pryor et al. and in co-pending U.S. patent application Ser. No. 167,084, filed July 9, 1980 to Pryor et al., now U.S. Pat. No. 4,329,863, 260,491, filed May 4, 1981 to Brenneman, now U.S. Pat. No. 4,412,439, filed Sept. 11, 1981 to Brenneman et al., now U.S. Pat. No. 4,414,832. This approach passes the strip material through a mill having back-up and work rolls to provide, for example, three reductions per pass. Forward and back tensions are applied to the strip during rolling. In utilizing this approach, it has been found that optimum process stability requires that the circumferential velocities of the entry and exit rolls equal that of the contacting strip material.

In U.K. Patent Application No. 2,004,486A by Vydrin, published Apr. 4, 1979, there is disclosed a method of rolling metal articles using a chosen ratio between the peripheral speeds of the work rolls less than the elongation of the article so that the specified unit tension applied to the article at the exit section thereof can be related to the ultimate strength of the metal emerging from the rolls. This is conducive to increasing the maximum elongation of the article and reducing the roll force by a considerable amount.

In accordance with this invention, a process and apparatus is provided for rolling metal strip and obtaining increased reductions at reduced values of the separating force and at minimized values of a tension force. These increased reductions between anneals are preferably achieved using a modified four-high rolling mill arrangement.

In accordance with the instant invention, increased reductions at reduced magnitudes of separating force and minimized values of tension force can be achieved using a rolling mill having relatively small diameter work rolls whose axes of rotation define a plane at an angle to the plane defined by the axes of rotation of the back-up rolls. The use of such an offset work roll configuration to form the roll bite through which the strip passes is desirable since it permits the use of smaller work rolls than could ordinarily be used. It has been unexpectedly found that by driving the aforementioned work roll configuration using a differential speed concept not to minimize separating force but rather only to reduce separating force, rolling with substantially no roll bending and roll flattening may take place even when taking very large single pass reductions on soft metal materials. It has also been unexpectedly found that by using the differential speed concept described herein, sufficient frictional forces can be generated between each back-up roll and its respective work roll to retain the work rolls in position and obviate the need for additional support structures to prevent roll bending in the rolling direction.

The differential speed concept utilized herein comprises driving the work rolls at a peripheral speed ratio less than the gage reduction ratio. This is done by driving a downstream or exit work roll at a peripheral speed substantially equal to the speed of the strip exiting the roll bite and by driving an upstream or entry work roll at a peripheral speed faster than the speed of the strip entering the roll bite but less than the peripheral speed of exit work roll. This differential speed concept alters the balance of forces so a resultant friction force is created in the direction of metal flow during rolling. As a result, the burden of large reductions is not imposed upon the mechanism for applying a forward tension to the strip. The applied tension forces may be minimized since the wedge is partially driven through the roll bite by the resultant friction force, rather than only being pulled through the roll bite by the tension force.

Accordingly, it is an object of this invention to provide a process and apparatus for increasing the reduction that can be obtained in a strip material in a single pass.

It is a further object of this invention to provide a process and apparatus as above for increasing the reduction that can be obtained using reduced compression force and minimized tension force magnitudes to effect the desired reduction.

It is a further object of this invention to provide a process and apparatus as above which uses relatively small diameter work rolls to produce the desired reduction per pass without the need for additional supports to prevent roll bending in the direction of rolling.

These and other objects will become more apparent from the following description and drawings wherein like numerals depict like parts.

In accordance with this inventin, an apparatus and process for inreasing the amount of reduction that can be obtained in a metal strip per pass is provided. Although the apparatus and process of the instant invention may be used with any metal or metal alloy capable of plastic deformation, it has particular utility with soft metal materials. As used herein, the term soft metal material means a strip of metal or metal alloy having a modulus of elasticity well below that of steel and mechanical properties below 100 ksi flow stress. Soft metal materials may include copper alloys, aluminum alloys, lead-tin alloys, etc.

The apparatus and process of the instant invention are capable of producing desired increased reductions in the thickness of a metal strip per pass through a rolling mill by using an offset arrangement of relatively small diameter work rolls and by creating a resultant friction force in the direction of rolling. The use of relatively small diameter, offset work rolls coupled with the creation of a friction force in the rolling direction substantially reduces the separating force that need be applied to the work rolls and minimizes the tension forces that need be applied to the strip to obtain the desired increased reductions per pass through the mill. Another advantage of the invention described herein is that the relatively small diameter work rolls are not subjected to significant roll flattening or roll bending and may be used without any supports other than the ordinary back-up rolls and frame supports of a rolling mill for preventing roll bending in the rolling direction.

The apparatus and process of the instant invention are particularly adapted for use with a rolling mill similar to the cooperative rolling mill described in the Pryor et al. patent and will be described in conjunction with such a mill. However, the apparatus and process of the instant invention could be adapted to other types of rolling systems.

Figure 1:
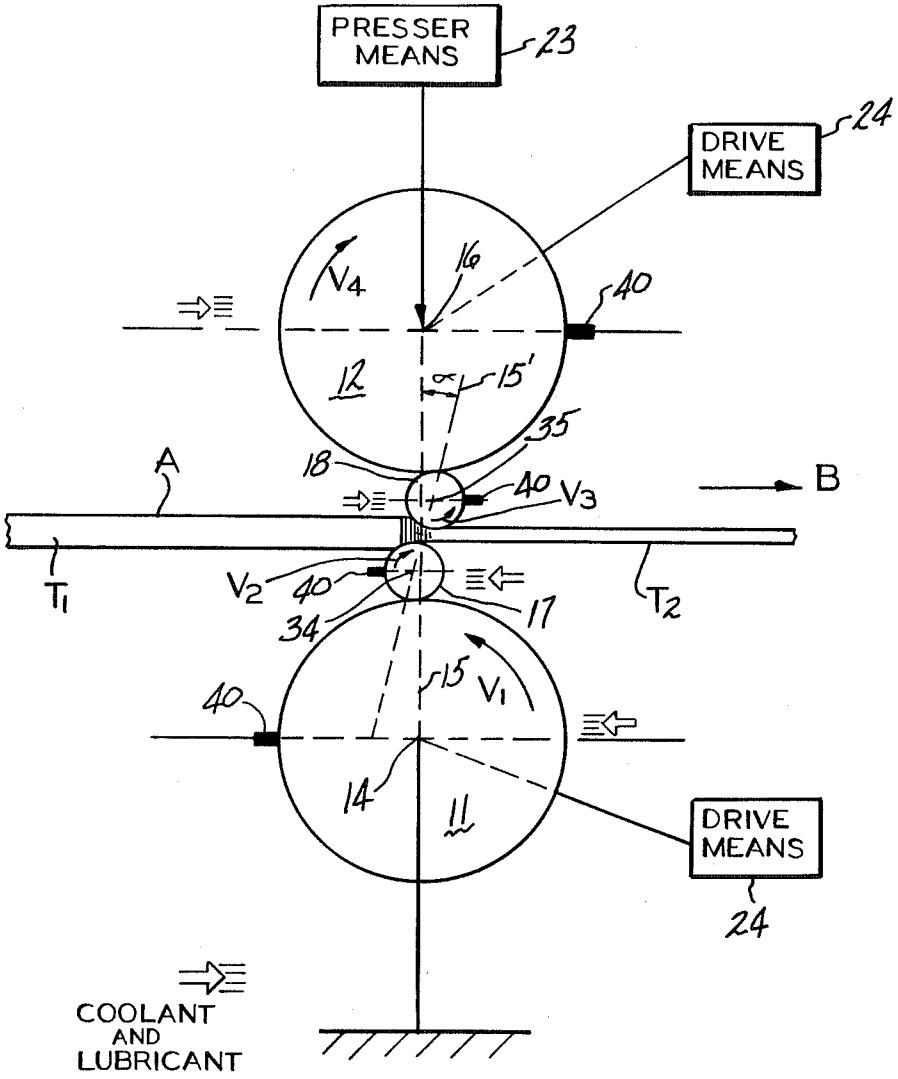
FIG. 1 is a schematic illustration of a side view of an apparatus in accordance with an embodiment of this invention.
Figure 3:
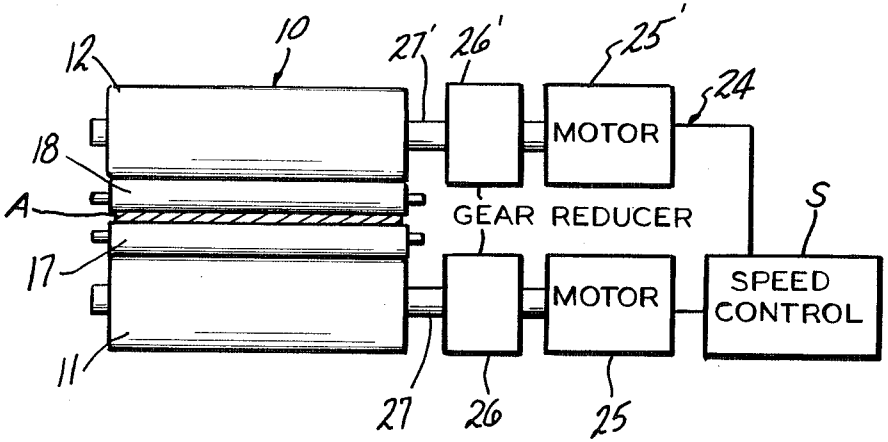
FIG. 3 is a partial view showing the drives to the rolls of the apparatus of FIG. 1.
Figure 2:
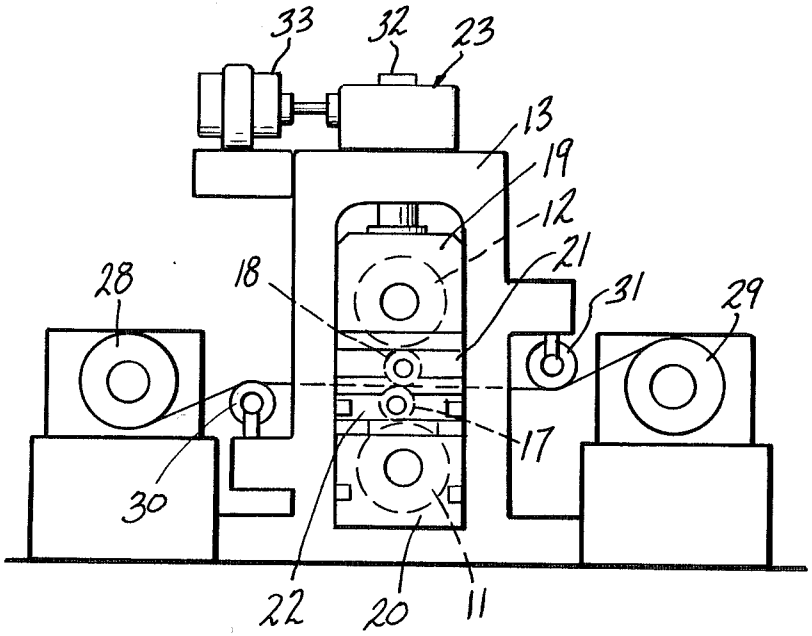
FIG. 2 is a more detailed illustration of the apparatus of FIG. 1.

Referring now to FIGS. 1–3, there is shown by way of example a rolling mill 10 in accordance with a preferred embodiment of the present invention. The rolling mill 10 comprises first 11 and second 12 back-up rolls of relatively large diameter. The lower back-up roll 11 is journaled for rotation in the machine frame 13 of the rolling mill about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are preferably two free wheeling work rolls 17 and 13 having a diameter substantially smaller than the diameter of the back-up rolls 11 and 12. When rolling in the direction of arrow B, work roll 17 forms the upstream or entry work roll and work roll 18 forms the downstream or exit work roll. The work rolls 17 and 18 are journaled for rotation and are preferably arranged to idle in the machine frame 13. They are each preferably adapted to float in a vertical direction. The specific support mechanisms 19, 20, 21, 22, etc. for the respective rolls 11, 12, 17 and 18 of the mill 10 may have any desired structure in accordance with conventional practice.

A motor driven screw down presser means 23 of conventional design is utilized to provide a desired compressive force, known as the separating force, between the back-up rolls 11 and 12 and their cooperating work rolls 17 and 18 and between the work rolls themselves. The presser means 23 may be of any conventional design and may be either hydraulically actuated not shown or screw 32 actuated through a suitable motor drive 33.

When the strip is rolled in the direction of arrow B, the speed relationship between the lower work roll 17 and the upper work roll 18 is such that the peripheral speed $V_2$ of the lower work roll 17 is less than the peripheral speed $V_3$ of the upper work roll 18. The work rolls 17 and 18 are preferably driven by the back-up rolls 11 and 12, respectively, in a manner to be described hereinafter. Alternatively, the work rolls 17 and 18 may be arranged so that either both are directly driven by motors or one acts as a drive roll and the other acts as a driven roll In a preferred arrangement, back-up rolls 11 and 12 are driven by a two motor drive 24 as shown in FIG. 3. The upper back-up roll 12 is driven at a different peripheral speed $V_4$ than the peripheral speed $V_1$ of the lower backup roll 11. When rolling in the direction of arrow B, $V_4$ preferably greater than $V_1$. The back-up rolls 11 and 12 are driven by motors 25 and 25' which are connected to the rolls 11 and 12 through reduction gear boxes 26 and 26' and drive spindles 27 and 27'. A speed control S is connected to the motors 25 and 25' in order to drive the rolls 11 and 12 at a desired peripheral speed ratio. The particular drive system 24 which has been described above does not form part of the present invention, and any desired drive system for driving the rolls 11 and 12 at a desired peripheral speed ratio could be employed.

In order to permit the use of smaller diameter work rolls so that the magnitude of separating force needed to effect the desired reductions may be substantially reduced, the plane 15' of the work rolls 17 and 18 defined by the axes 34 and 35 of the work rolls 17 and 18 is offset from the plane 15 by a desired tilt angle $\alpha$. Any suitable tilt angle as known in the art may be defined between the plane 15' of the work rolls 17 and 18 and the plane 15 of the back-up rolls 11 and 12. In a preferred arrangement, the tilt angle $\alpha$ is less than about 24°, most preferably about 20°. The use of such a tilt angle permits the work rolls to have a diamter of about 6 inches or less, preferably about 5 inches or less in diameter. The lower limit on the work roll diameter would be the diameter that does not enable the work roll to friction couple with its back-up roll. The work rolls 17 and 18 are preferably offset in the direction of rolling, namely clockwise as viewed in FIG. 1.

It is known in the prior art to drive a pair of rolls forming a roll bite so that there is a slower roll and a faster roll. Ordinarily in this type of arrangement, the slower roll is driven at a peripheral speed $V_a$ substantially equal to the speed of the strip $S_i$ entering the roll bite, while the faster roll is driven at a peripheral speed $V_b$ substantially equal to the speed of the strip $S_o$ exiting the roll bite. The gage reduction ratio $\lambda$ is equal to the ratio of the faster roll speed $V_b$ to the slower roll speed $V_a$ or, in other words, the ratio of the strip exit speed $S_o$ to the strip entry speed $S_i$.

By driving the rolls in this prior art manner, frictional forces are ideally equal and opposite, thereby cancelling out friction and minimizing separating force. However, by eliminating friction as a means of driving metal through the rolls, forward motion of the workpiece or strip can be obtained only by applying a tension force to pull the strip through the roll bite. When relatively large tension forces are required to pull the strip through the roll bite, there is a substantial risk of strip breakage, particularly with strips comprising a soft metal material.

In accordance with the instant invention, it has been unexpectedly found that the tension force needed to effect a desired increased reduction may be minimized and the separating force needed to effect the desired increased reduction may be substantially reduced by driving the offset work rolls 17 and 18 using a differential speed concept. Using the differential speed concept described herein, the separating force magnitude needed to effect the desired reduction may be sufficiently reducted that small diameter work rolls can be used with substantially no roll bending and roll flattening taking place during rolling, even when taking relatively large single pass reductions. Furthermore, by operating the work rolls in accordance with the differential speed concept described hereafter, sufficient friction forces can be generated that the need for additional supports other than the back-up rolls 11 and 12 and the roll support mechanisms 19, 20, 21, 22, etc. for preventing roll bending in the rolling direction is obviated.

The differential speed concept of the instant invention comprises driving the work rolls 17 and 18 at a peripheral speed ratio $V_3/V_2$ less than the gage reduction ratio $\lambda$ but greater than zero. When rolling in the direction of arrow B, this is done by driving work roll 18 so as to retain the no slip point at the exit of the roll bite. This is effected by driving work roll 18 at a peripheral speed $V_3$ substantially equal to the speed $S_o$ of he strip A exiting the roll bit. Instead of driving work roll 17 at a peripheral speed equal to the speed of the strip entering the roll bite, work roll 17 is preferably driven at a peripheral speed $V_2$ faster than the strip entry speed $S_i$. Work roll 17 is preferably driven in accordance with the following equation:

$$V=S_i+K(S_o-S_i) \quad (1)$$

where $V$=peripheral speed of entry work roll
$S_i$=strip entry speed
$K$=about 0.5± about 0.25
$S_o$=strip exit speed
$S_o-S_i$=speed difference Preferably, work roll 17 is driven at a speed $V_2$ equal to the strip entry speed plus about 50% of the speed difference.

By operating in this fashion, the balance of forces is altered so the frictional relationship between each of the work rolls 17 and 18 and the strip A produces or creates a resultant friction force F in the diretion of metal flow during rolling. The wedge is partially driven through the roll bite by this resultant driction force. As a result, the amount of forward tension $T_2$ that need be exerted on strip A to pull the wedge through the roll bite to effect the desired reduction may be minimized. By minimizing the amount of forward tension exerted on strip A for a desired increased reduction, the likelihood of exceeding the strip's tensile strength and of breaking the strip is substantially minimized.

The use of relatively small diameter work rolls in an offset configuration and the differential speed concept described hereinbefore permit increased reductions in strip gage at substantially reduced separating force magnitudes. The advantages of substantially reduced separating force magnitudes include substantial elimination of roll bending and roll flattening. By substantially eliminating roll bending and roll flattening, improved gage control and improved flatness of the strip material can be achieved.

It is believed that the need for additional support structures other than the back-up rolls 11 and 12 and support mechanisms 19, 20, 21, 22, etc. for preventing bending in the rolling direction of work rolls 17 and 18, particularly the downstream one of the work rolls, is obviated by the frictional forces created between each work roll and its respective back-up roll, primarily by the manner in which the rolls are driven. For example, when rolling in the direction of arrow B, the resultant friction force created between the downstream work roll 18 and its back-up roll 12 is greater than the resultant friction force created by the differential speed concept used to drive the work rolls. This resultant friction force created between work roll 18 and back-up roll 12 is sufficient to retain work roll 18 in its position. Likewise, the friction force created between work roll 17 and its back-up roll 11 is sufficient to maintain the position of work roll 17.

In operation, strip A is threaded in a conventional manner through the roll bite formed by the work rolls 17 and 18. When rolling in the direction of arrow B, coiler/decoiler 28 applies a sufficient back tension $T_1$ to strip A to prevent slipping and coiler/decoiler 29 applies a forward tension $T_2$ to strip A for pulling the strip material through the roll bite. If desired, strip A may pass over billy or idler rolls 30 and 31. When rolling in the direction opposed to that of arrow B, the roles of the coiler/decoilers 28 and 29 are reversed.

The back-up rolls 11 and 12 and consequently the work rolls 17 and 18 are driven as previously described. The separating force is applied by presser means 23.

During operation, coolant and lubricant may be selectively applied to any or all of the rolls 11, 12, 17 and 18. The specific apparatus for applying the coolant and lubricant may be of any desired conventional design as is known in the art. The amount of coolant and lubricant applied is preferably controlled so that the frictional relationships created between the work rolls 17 and 18 and their respective back-up rolls 11 and 12 and between the work rolls 17 and 18 and the surfaces of strip A by the differential speed concept used herein are not disturbed. If desired, the volume of coolant and lubricant on each roll may be controlled using a system of wipes 40.

Wipes 40 are each preferably formed by a permeable membrane impregnated with a solvent. Preferably, wipes 40 comprise a felt strip impregnated with kerosene; however, any suitable permeable membrane and any suitable solvent may be used.

The system for applying coolant and lubricant and the system of wipes 40 shown in FIG. 1 are merely exemplary and any suitable arrangement for providing coolant and lubricant and any suitable arrangement of the wipes 40 may be utilized. For example, two sets of wipes not shown may be provided so that one set is in contact with the rolls while the second set is in a retracted position when rolling in a first direction and the second set is in contact with the rolls while the first set is in a retracted position when rolling in a second direction opposed to the first direction. Each set of wipes may have suitable retraction means not shown to move it in and out of contact with the rolls.

If mill 10 is to be used as a reversing mill, speed control S should be capable of driving the back-up rolls 11 and 12 so that when the strip is rolled in the direction opposite to that of arrow B, work roll 17 is the faster roll and work roll 18 is the slower roll. By reversing the rolling speeds and rolling in a direction opposite to that of arrow B, a resultant friction force will be created in the direction opposite to that of arrow B.

Figure 4:
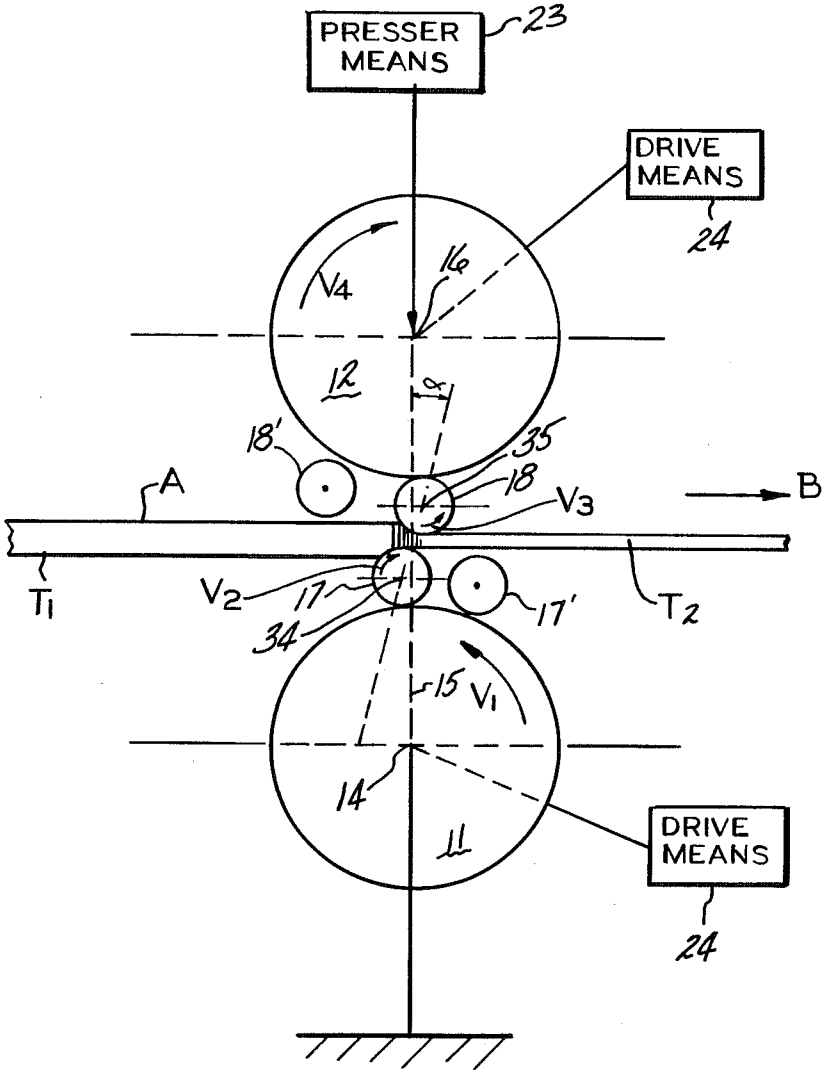
FIG. 4 is a schematic illustration of a side view of an apparatus in accorodance with an alternative embodiment of this invention.

Instead of reversing the peripheral speeds of the work rolls, one may provide the mill 10 with a second set of work rolls 17' and 18' as shown in FIG. 4. Depending upon the direction of rolling, either rolls 17 and 18 or rolls 17' and 18' would be in contact with the back-up rolls 11 and 12. Suitable means not shown for moving the rolls 17 and 18 and the rolls 17' and 18' in and out of contact with the back-up rolls 11 and 12 and for supporting the work rolls 17, 17', 18 and 18' in the frame 13 may be provided. The roll moving means may comprise any suitable conventional moving arrangement as are known in the art. Likewise, the work roll supporting means may comprise any conventional mechanisms known in the art. The mill 10 may also be provided with any suitable means for selectively applying coolant and lubricant to one or more of the rolls 11, 12, 17, 17', 18 and 18' and any suitable system of wipes, if desired, to control the amount of coolant and lubricant on each roll.

When mill 10 is operated in the direction of arrow B, work rolls 17 and 18 are in contact with back-up rolls 11 and 12, respectively, and work rolls 17' and 18' are in a retracted position. Speed control S operates the motors 25 and 25' so that back-up rolls 11 and 12 are driven to provide work roll 18 with a peripheral speed substantially equal to the speed of strip A exiting the roll bite and to provide work roll 17 with a peripheral speed in accordance with equation (1). When mill 10 is operated in the direction opposite to that of arrow B, work rolls 17' and 18' are in contact with back-up rolls 11 and 12, respectively, and work rolls 17 and 18 are in a retracted position. Speed control S operates the motors 25 and 25' so that back-up rolls 11 and 12 are driven to provide work roll 18' with a peripheral speed substantially equal to the speed of the strip exiting the roll bite and to provide work roll 17' with a peripheral speed in accordance with equation (1).

In summary, a system for operating a rolling mill to provide increased reductions in strip thickness at reduced values of separating force and minimal values of tension force for a given reduction has been disclosed herein. The system in accordance with the instant invention creates sufficient frictional forces that small diameter work rolls may be used without having to provide support structures in the rolling direction other than the ordinary back-up rolls and frame support mechanisms of a four high mill. The system described herein uses a speed differential concept to produce the aforementioned benefits. The system of the instant invention is particularly useful in providing increased reductions to materials which have previously been limited in the amount of reduction that could be taken because of the limited tensile forces that could be applied without breaking the material forming the strip.

It is believed that the invention described herein is widely applicable to the rolling of stainless steel, copper, copper base alloys, iron and iron alloys, nickel and nickel alloys, aluminum and aluminum alloys as well as any other metal, alloy or other material susceptible of plastic deformation.

While the instant invention has been described with respect to as particular rolling apparatus and process, it is applicable to other types of rolling apparatuses.

The word "strip" as used herein is intended to include wires, tubes, rods, and any other continuous material having any suitable cross-sectional shape.

The ratio between the diameters of the back-up rolls 11 and 12 and the diameters of the work rolls 17 and 18 as used herein should preferably range from about 2:1 to 9:1 and most preferably from about 3:1 to 8:1. By using back-up rolls and work rolls having diameters within these ranges, the apparatuses as shown in FIGS. 1–4 are adapted to lower the separating forces needed to effect a desired reduction as compared to a conventional four-high mill.

In lieu of wipes, any suitable means for maintaining good friction between the rolls, particularly between each back-up roll and its respective work roll, may be used with the mill of either FIG. 1 or FIG. 4. Such means may include roughened back-up rolls, cast iron rolls, etc.

While a vertical arrangement of the roll stack has been shown, they can be arranged horizontally or otherwise as desired.

The patents, patent applications, publications and articles set forth in the background of this application are intended to be incorporated by reference herein.

It is apparent that there has been provided in accordance with this invention a process and apparatus for producing high reduction in soft metal materials which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A rolling mill for reducing the thickness of a strip material being rolled, said mill comprising:

at least two driven back-up rolls, each of said back-up rolls having an axis of rotation;

said axes of rotation defining a first plane;

at least two offset idler work rolls forming a roll bite through which said strip material passes in a desired rolling diretion to effect a desired gage reduction in said strip material thickness, each of sid work rolls having an axis of rotation and being in contact with a respective one of said back-up rolls;

said work rolls being arranged so that said axes of rotation of said work rolls forming said roll bite are positioned on opposite sides of said first plane and define a second plane at an angle to said first plane;

means for applying a compressive force having a desired magnitude to said rolls to effect said desired gage reduction; and means driving said work rolls forming said roll bite at a peripheral speed ratio less than the desired gage reduction but greater than zero for creating a first resultant frictional force acting in said rolling direction for at least partially driving said strip material through said roll bite, said work roll driving means comprising said work rolls being driven by respective ones of said driven back-up rolls.

2. The rolling mill of claim 1 further comprising:

means for rotatably supporting said back-up and work rolls; and said work roll driving means and said compressive force applying means comprising means for creating a second resultant frictional force between a downstream one of said work rolls and its repsective back-up roll, said second resultant frictional force acting in a direction opposite to said rolling direction and being greater than said first resultant frictional force so that said downstream work roll is retained in its position with respect to said rolling direction without the need for additional support structures to prevent roll bending in said rolling direction.

3. The rolling mill of claim 1 further comprising:

means for applying a forward tension force having a given magnitude to said strip material to pull said strip material through said roll bite; and said work roll driving means further comprising means for minimizing the magnitude of said tension force needed to pull said strip material through said roll bite to obtain said desired gage reduction and for substantially reducing the risk of breaking said strip material.

4. The rolling mill of claim 1 further comprising:

said strip material having a first strip speed prior to entering said roll bite and a second strip speed after exiting said roll bite, the ratio of said second strip speed to said first strip speed defining said gage reduction; and said work roll driving means further comprising:

means for driving a downstream one of said work rolls at a first peripheral speed substantially equal to said second strip speed; and means for driving an upstream one of said work rolls at a second peripheral speed greater than said first strip speed but less than said second strip speed.

5. The rolling mill of claim 4 wherein said second peripheral speed is in accordance with the following equation:

$$V=S_i+K(s_o-S_i)$$

where

V=said second peripheral speed $S_i$=said first strip speed $S_o$=said second strip speed K=bout 0.5± about 0.25.

6. The rolling mill of claim 4 wherein said second peripheral speed is in accordance with the following equation:

$$V=S_i+K(S_o-S_i)$$

where

V=said second peripheral speed $S_i$=said first strip speed $S_o$=said second strip speed K=about 0.5.

7. The rolling mill of claim 1 further comprising:

said angle between said first and second planes being greater than zero but less than about 24°.

8. The rolling mill of claim 1 further comprising:

said at least two work rolls comprising a first set of at least two offset work rolls and a second set of at least two offset work rolls, said first set of work rolls being in contact with said back-up rolls when rolling in a first direction and being retracted out of contact with said back-up rolls when rolling in a second direction opposed to said first direction and said second set of work rolls being in contact with said back-up rolls when rolling in said second direction and being retracted out of contact with said back-up rolls when rolling in said first direction.

9. The rolling mill of claim 1 wherein:

said work rolls each have a relatively small diameter as compared to the diameter of each said back-up roll; and said driving means further comprises means for substantially reducing the magnitude of said compressive force that need be applied to effect said desired gage reduction and for substantially eliminating roll bending and roll flattening of said work rolls.

10. The rolling mill of claim 9 wherein:

said rolling mill comprises a reversible rolling mill; and said work rolls each have a diameter less than about six inches.

11. The rolling mill of claim 1 further comprising:

said back-up rolls being driven by a motor drive, said motor drive forming the sole motor drive for said mill.

12. A process for reducing the thickness of a strip material, said process comprising:

providing a rolling mill having at least two driven back-up rolls and at least two offset idler work rolls, each of said back-up rolls and said work rolls having an axis of rotation;

orienting said back-up rolls so that said back-up roll axes of rotation define a first plane;

orienting said offset work rolls so that said work roll axes of rotation are positioned on opposite sides of said first plane and define a second plane at an angle to said first plane;

passing said strip material through a roll bite defined by said offset work rolls in a desired rolling direction to effect a desired gage reduction in said strip material thickness;

applying a compressive force having a desired magnitude to said rolls to effect said desired gage reduction; and driving said offset work rolls forming said roll bite at a peripheral speed ratio less than the gage reduction but greater than zero and thereby creating a first resultant frictional force in said rolling direction which at least partially drives said strip material through said roll bite and reduces the magnitude of the compressive force needed to obtain said desired gage reduction, said driving step comprising driving said work rolls with respective ones of said driven back-up rolls.

13. The process of claim 12 further comprising:

rotatably supporting said back-up and work rolls; and said step sof applying a compressive force and driving said work rolls creating a second resultant frictional force between a downstream one of said work rolls and its respective back-up roll acting in a direction opposed to said rolling direction and having a magnitude greater than said first resultant frictional force, said second resultant frictional force retaining said downstream work roll in its position with respect to said rolling direction without the need for additional support structures for preventing roll bending in said rolling direction.

14. The process of claim 12 further comprising:

applying a forward tension force having a given magnitude to said strip material for pulling said strip material through said roll bite; and said step of driving said work rolls further comprising minimizing the magnitude of the tension force needed to be applied to said strip material to obtain said desired gage reduction and thereby minimizing the risk of breaking said strip material.

15. The process of claim 12 further comprising:

passing said strip material into said roll bite at a first strip speed;

withdrawing said strip material from said roll bite at a second strip speed, the ratio of said second strip speed to said first strip speed being equal to said gage reduction; and said step of driving said work rolls further comprising:

driving a downstrean one of said work rolls at a first peripheral speed substantially equal to said second strip speed; and driving an upstream one of said work rolls at a second peripheral speed greater than said first strip speed but less than said second strip speed.

16. The process of claim 15 wherein said step of driving said upstream work roll comprises:

driving said upstream work roll at a peripheral speed in accordance with the following equation:

$$V=S_i+K(S_o-S_i)$$

where

V=said upstream work roll peripheral speed $S_i$=said first strip speed $S_o$=said second strip speed K=about 0.5± about 0.25.

17. The process of claim 12 wherein said step of orienting said work rolls comprises:

orienting said offset work rolls so that said angle defined by said first and second planes is greater than zero but less than about 24°.

18. The process of claim 12 further comprising said step of providing at least two work rolls comprising providing a first set of at least two offset work rolls and a second set of at least two offset work rolls;

placing said first set of work rolls in contact with said back-up and maintaining said second set of work rolls out of contact with said back-up rolls when rolling in a first direction; and placing said second set of work rolls in contact with said back-up rolls and maintaining said first set of work rolls out of contact with said back-up rolls when rolling in a second direction opposed to said first direction.

19. The process of claim 12 wherein:

said step of providing at least two work rolls comprises providing at least two work rolls each having a relatively small diameter as compared to the diameter of each said back-up roll; and said step of driving said work rolls at a peripheral speed ratio less than the gage reduction but greater than zero substantially eliminating roll bending of said work rolls in the rolling direction and roll flattening.

20. The process of claim 12 wherein said step of driving said work rolls further comprises:

driving only said back-up rolls with a motor drive system.

* * * * *